US006845712B2

(12) United States Patent
Leonhardt et al.

(10) Patent No.: US 6,845,712 B2
(45) Date of Patent: Jan. 25, 2005

(54) AUTOMATIC TRANSMISSION OF DATA FROM THE PRE-PRESS STAGE TO A PRINTING PRESS

(75) Inventors: Holger Leonhardt, Meckesheim (DE); Claus Peter Zander, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/449,477

(22) Filed: May 29, 2003

(65) Prior Publication Data

US 2003/0221573 A1 Dec. 4, 2003

(30) Foreign Application Priority Data

May 31, 2002 (DE) ..... 102 24 302

(51) Int. Cl.[7] ..... B41C 1/10; B41F 33/00
(52) U.S. Cl. ..... 101/463.1; 101/480; 101/484
(58) Field of Search ..... 101/219, 401.1, 101/463.1, 465, 466, 467, 480, 484, 485, 486

(56) References Cited

U.S. PATENT DOCUMENTS

| | | | | |
|---|---|---|---|---|
| 3,650,204 A | * | 3/1972 | Burger et al. | 101/45 |
| 3,841,215 A | * | 10/1974 | Hasegawa | 101/148 |
| 4,082,039 A | * | 4/1978 | Schutt et al. | 101/450.1 |
| 4,129,073 A | * | 12/1978 | Ritzerfeld | 101/2 |
| 4,328,749 A | * | 5/1982 | Inouye et al. | 101/138 |
| 4,665,824 A | | 5/1987 | Greiner et al. | 101/426 |
| 5,058,500 A | | 10/1991 | Mizuno | 101/142 |
| 6,119,594 A | * | 9/2000 | Kipphan et al. | 101/365 |
| 6,167,806 B1 | | 1/2001 | Chretinat et al. | 101/220 |

FOREIGN PATENT DOCUMENTS

| | | |
|---|---|---|
| DE | 3339552 | 5/1985 |
| DE | 3908270 | 8/1997 |
| DE | 19856675 | 9/1999 |
| DE | 10110640 | 10/2001 |
| EP | 0894624 | 11/2001 |
| JP | 2001158075 | 6/2001 |

* cited by examiner

*Primary Examiner*—Stephen R. Funk
(74) *Attorney, Agent, or Firm*—Davidson, Davidson, Kappel, LLC

(57) ABSTRACT

A method and a device for automatically transmitting data from a pre-press stage (9) to a printing substrate processing machine (8) having at least one print unit (10) and one print form (11) for printing on a printing substrate (1). The method and the device are distinguished in that the data of the pre-press stage (9) to be transmitted to the printing substrate processing machine (8) are applied in an encoded form to the print form (11), and these data are able to be read out by the printing substrate processing machine (8). Also provided is a method and a device for automatically transmitting data from a first printing substrate processing machine (8) having at least one print unit (10) and one print form (11) for printing on a printing substrate (1), to a further printing substrate processing machine, in particular a folding machine. This method and this device are distinguished in that the data to be transmitted to the further printing substrate processing machine are applied in the first printing substrate processing machine (8), in a machine-readable form, to the print form (11), and these data are read out by the further printing substrate processing machine.

21 Claims, 3 Drawing Sheets

AUTOMATIC TRANSMISSION OF DATA FROM THE PRE-PRESS STAGE TO A PRINTING PRESS

Priority to German Patent Application No. 102 24 302.6, filed May 31, 2002 and hereby incorporated by reference herein, is claimed.

BACKGROUND INFORMATION

The present invention is directed to a method and a device for automatically transmitting data from the pre-press stage to a printing substrate processing machine having at least one print unit and one print form for printing on a printing substrate, as well as to a method and a device for automatically transmitting data from a first printing substrate processing machine having at least one print unit and one print form for printing on a printing substrate, to a further printing substrate processing machine, in particular a folding machine.

The term pre-press stage generally denotes all required work steps, ranging from preparation of the text, the original images and graphics, and the layout, to production of a press-ready print form. The print form created in the process is then used for producing the print run in the printing press. In multi-color printing, the individual color separations are also prepared in the pre-press stage. Each of these require producing a separate print form which, after being printed one after another on a substrate, together, ultimately produce the color print. In this context, it is important that the individual color separations be imprinted true-to-register on the substrate, since, otherwise, the print quality suffers. It is also necessary that the correct chromatic values for the individual color separations be communicated from the pre-press stage to the printing press, to ensure that the print result in the main press stage corresponds to the original underlying the pre-press stage. Other data, which need to be transmitted from the pre-press stage to the main press stage, also include, for example, the print volume, i.e., the number of prints to be produced. These data must be communicated in some way from the pre-press stage to the main press stage.

One known way to effect this provides for print job dockets in which the necessary data are recorded in paper form. The job sheets in the print job dockets contain the data generated in the pre-press stage in printed form. They are packed in print dockets, transported to the main press stage and, finally, to the particular printing press for further processing of the finished prints.

One modern system provides for the transmission of data from the pre-press stage to the main press stage using memory cards on which data of the pre-press stage are stored. The memory card described in the pre-press stage is taken from the read and write unit of the pre-press stage and transported to the read unit of the main press stage, where it is used. There, the memory card is read out, and the data for a print job are input into the main press stage.

In the meantime, methods are now being used in print shops having largely digitized work flow, where the pre-press stage and the main press stage are interconnected via a digital data transmission link. In this context, various computers of the pre-press stage are networked with one another and communicate, for example, over Ethernet or other LAN/WAN networks with a computer of the main press stage. Due to its high costs, this type of networking only proves to be practical in large print shops where, in the majority of cases, both the pre-press stages, as well as the main press stage are combined under one roof. In smaller print shops, the pre-press stage is often located outside of the print shop, so that finished print forms are delivered to the print shop for the printing operation.

BRIEF SUMMARY OF THE INVENTION

An object of the present invention is to devise a method and a device for transmitting data from a pre-press stage to a main press stage, which do not require an expensive data transmission network between the pre-press stage and the main press stage, but, nevertheless, make it possible for the transmission of data from the pre-press stage to the main press stage to be largely automated.

The present invention provides a method and device for automatically transmitting data from a pre-press stage (9) to a printing substrate processing machine (8) having at least one print unit (10) and one print form (11) for printing on a printing substrate (1), wherein the data to be transmitted to the printing substrate processing machine (8) are applied in the pre-press stage (9), in a machine-readable form, to the print form (11), and these data are read out by the printing substrate processing machine (8).

The present invention also provides a method and device for automatically transmitting data from a first printing substrate processing machine (8) having at least one print unit (10) and one print form (11) for printing on a printing substrate (1), to a further printing substrate processing machine, in particular a folding machine, wherein the data to be transmitted to the further printing substrate processing machine are applied in the first printing substrate processing machine (8), in a machine-readable form, to the print form (11), and these data are read out by the further printing substrate processing machine.

A significant advantage of the methods and the devices is that data from the pre-press stage are able to be automatically transmitted to the main press stage, without necessitating a data network as a communications link between the main press stage and the pre-press stage, and without the need for transporting a memory card from the pre-press stage to the main press stage. In addition, data in machine-readable form may be transmitted from a first printing substrate processing machine to another machine. The data to be transmitted, which are usually already available as digital data in the pre-press stage, are recorded on the print form as machine-readable encoded data, i.e., the print form not only contains a color-separation component, but preferably, in one of its edge regions which are not used for the printing operation, the encoded data to be transmitted. Then, for example, when the print form is inserted into the main press stage, thus into the printing cylinder of a printing press, these encoded data are applied, together with the color-separation component, to the substrate to be printed on. Using a sensor provided in the printing press, the data printed on the substrate may then be read out downstream from the print unit having the encoded print form and transmitted to the press control unit. Compared to the use of memory cards for transmitting data between the pre-press stage and the main press stage, the method and the device according to the present invention offer the substantial benefit of ensuring that mix-ups do not occur. Contrary to the situation where the print job is stored on a memory card, it is not possible for the printer to accidentally assign the wrong print job to a print form, because the print form strictly contains the print data belonging to it.

If, as a printing substrate processing machine, a printing press is used where the print form is directly imaged on the printing cylinder, for the most part, by using a laser beam, such as a printing press of the Heidelberg DI series, then data to be transmitted may be written to the print form in the printing press, as well, and subsequently applied to a substrate. In another printing substrate processing machine, such as a folding machine, these data are then read out by a reader device such as a scanner and transmitted to the folding machine control. In this way, data may be transmitted from printing presses to folding machines without any communication taking place between them via a network or through the exchange of chip cards.

In accordance with a first embodiment of the present invention, the data to be transmitted in the printing substrate processing machine are applied to the substrate using the print form. In this case, the data are imprinted, together with the corresponding color-separation component, on the substrate and subsequently read out by a sensor on a print unit.

From the first embodiment of the present invention, a further embodiment is derived which provides for the data to be applied to the print form which is inserted in the first print unit. This is advantageously carried out at the first print unit and, in particular, at the print unit which prints the black ink, so that the encoded data are already present in the machine control of the main press stage when the first substrate to be printed on reaches the second print unit. As a result, the first register deviation between the first and second print unit already meets high precision requirements.

Another embodiment of the present invention provides for applying the data to be transmitted in the printing substrate processing machines, in the lateral edge regions of the substrate. In today's printing processes, every substrate has edge regions where neither text nor graphics are printed. Instead, here one finds ink stripes and so-called register marks for controlling register trueness and, thus, for controlling the print quality of the printed substrate. In these edge regions, there are also still other unprinted surfaces which are excellently suited for printing the data to be transmitted. For that reason, it is practical in this case that the data be applied in the pre-press stage to such an unused edge region of the print form.

A further advantage is attained in that the encoded data contain the setpoint position of a register mark in relation to a sheet edge of a substrate. The correct position of a color separation component on a printed substrate is able to be ascertained by comparing the setpoint position of a register mark contained in the encoded data to the distance measurement between the register mark and a sheet edge of the substrate. In addition, when the encoded data are always located at the same position at the beginning of a sheet to be printed, this facilitates the task performed by the printing press sensors of finding a register mark, so that the sensor in the printing press responsible for assessing a register mark is able to find the register mark more easily.

A further advantage is attained when the data are applied to the print form in the form of a bar-code. The bar-code is a type of data coding that is especially easy to read and is fail-safe. Because of its simple graphic representation, it is also able to be simply applied in the pre-press stage to the print form. When certain bar-code methods are used, such as the KingNor method, in particular, this method also reacts relatively insensitively to geometric deviations and speed fluctuations of the substrate. This is an important consideration in the main press stage as well, which requires that the bar-code also be read out correctly again.

Another embodiment of the present invention provides that the data to be transmitted contain the number of printing operations to be executed. This makes it possible for the print volume of a printing operation to be automatically adjusted, thereby eliminating this additional step for the printer.

A similar advantage is provided by another embodiment of the present invention, according to which the data to be transmitted contain the sequence of the colors in the print units of a printing press, so that a comparison is made to the color sequence actually adjusted in the printing press. This embodiment ensures that the correct color belonging to the print form is provided in the inking systems of the individual print units, and, accordingly, that an alarm signal is emitted when there is a change in the color sequence in comparison to the previous print job. Thus, the printer receives a warning signal prompting him/her to check the color sequence and, if indicated, to fill the inking systems with another color.

It is also advantageously provided that the data to be transmitted contain information for optional equipment, such as tape inserters and numbering boxes, in particular. By way of this supplemental information, along with the other information, it is possible to automatically transmit the adjustment information pertaining to supplemental equipment, particularly in the post-press processing (finishing) stage as well. After the data are read out in the first print unit, they may be transmitted to the other optional equipment, such as tape inserters, numbering boxes, and folding units, so that this optional equipment is also automatically supplied with the data required for the pending print job.

The data to be transmitted also advantageously include the color profile pertaining to a particular print job. This ensures that the color profile from the pre-press stage is also directly transmitted to the main press stage, without the printer having to make further adjustments.

Yet another advantageous embodiment provides that the sensor provided in the main press stage for reading out the data on the print form, is able to read this data directly from the print form. In this case, the sensor is functionally mounted directly on the print form cylinder of the first print unit and scans an edge region of the rotating print form on the printing cylinder. In this way, it reads out the data, encoded, for example, in a bar-code, in the edge region of the print form and transmits the data directly to the machine control of the main press stage. Here, one derives a certain time advantage over the method where the data are not read out until after they are applied to the substrate. When the data arrive more quickly at the control of the main press stage, then a faster automatic control of the register accuracy is also possible, for example.

BREIF DESCRIPTION OF THE DRAWING

The present invention is described and explained in greater detail in the following on the basis of a drawing, in which.

DETAILED DESCRIPTION

Figure 1:
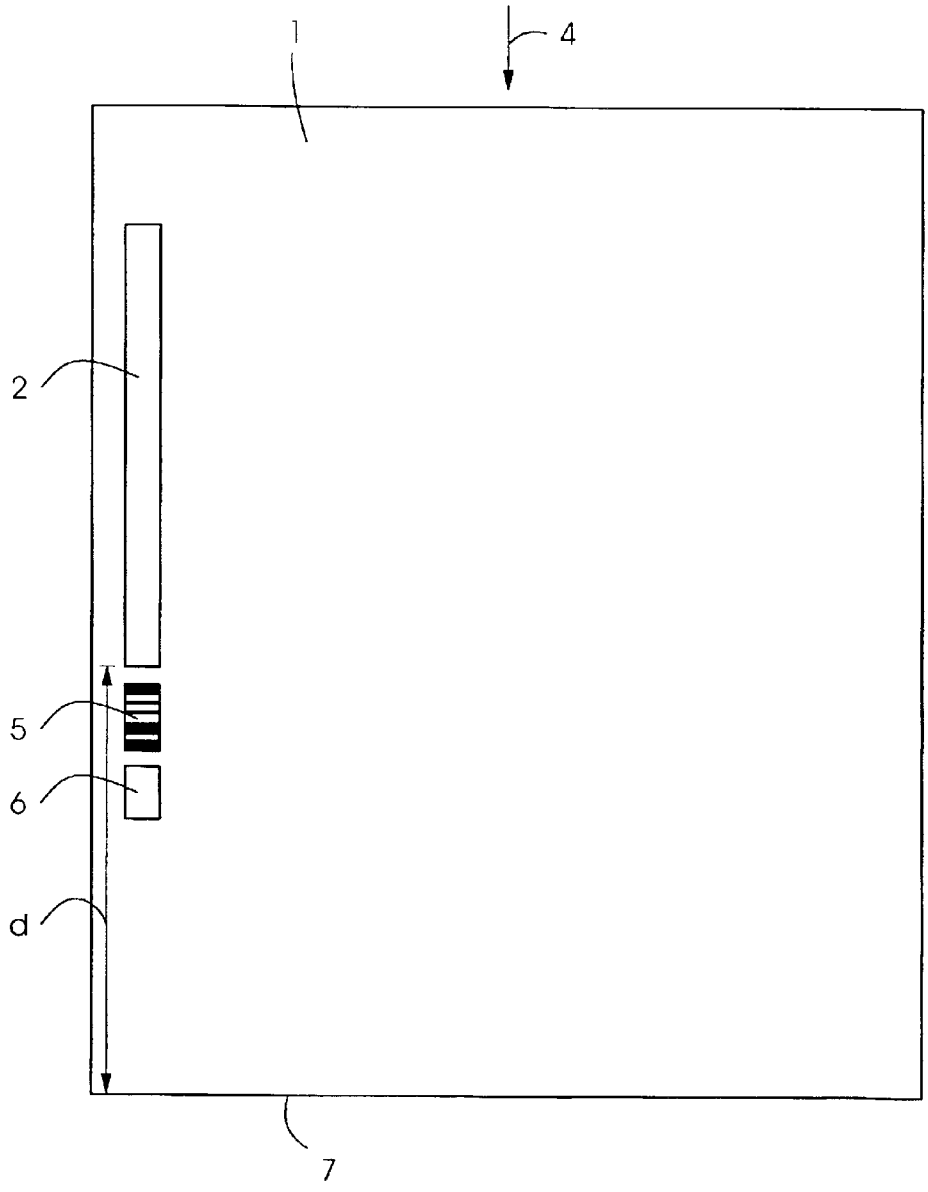
FIG. 1 shows a sheet printed on in accordance with the method of the present invention, in whose edge region on the right side in the sheet travel direction, the data to be transmitted are imprinted in the form of a bar-code and a register mark.

The substrate illustrated in FIG. 1, in this case a sheet 1, has on its right side in sheet travel direction 4, with respect to its front sheet edge 7, first of all, a so-called optional mark starting sequence 6 and, subsequently thereto, an encoded informational block 5. This informational block 5 is followed, likewise on the right side strip of sheet 1, by a register mark 2. The optional mark starting sequence 6, encoded informational block 5, and register mark 2 are located in a lateral region on which text or graphics are not printed. Register mark 2 has a certain distance d from sheet edge 7. Since register mark 2, including the imprinted text and graphics, is inseparably connected to a print form 11 (FIG. 3), the exact position of the entire printed image in relation to front sheet edge 7 is able to be determined on the basis of distance d between sheet front edge 7 and register mark 2.

Informational block 5 contains the data to be transmitted from a pre-press stage 9 to a printing substrate processing machine 8, in an encoded form, which, in this case, is a bar-code. The purpose of optional mark starting sequence 6 is, as the case may be, to make it easier to find the encoded data of informational block 5 when informational block 5 is not always in the same position. Mark starting sequence 6 then signals a read sensor 15, which scans the side strip(s) of a sheet 1, that an informational block 5 follows next, and not a register mark 2 or the like. In this context, read sensor 15 is designed as a bar-code reader. As a bar-code, preferably one encrypted in accordance with the so-called "KingNor method" is used, which is generally immune to existing deformations in the substrate and thus ensures a highly dependable reading of informational block 5 applied to a substrate 1.

Figure 2:
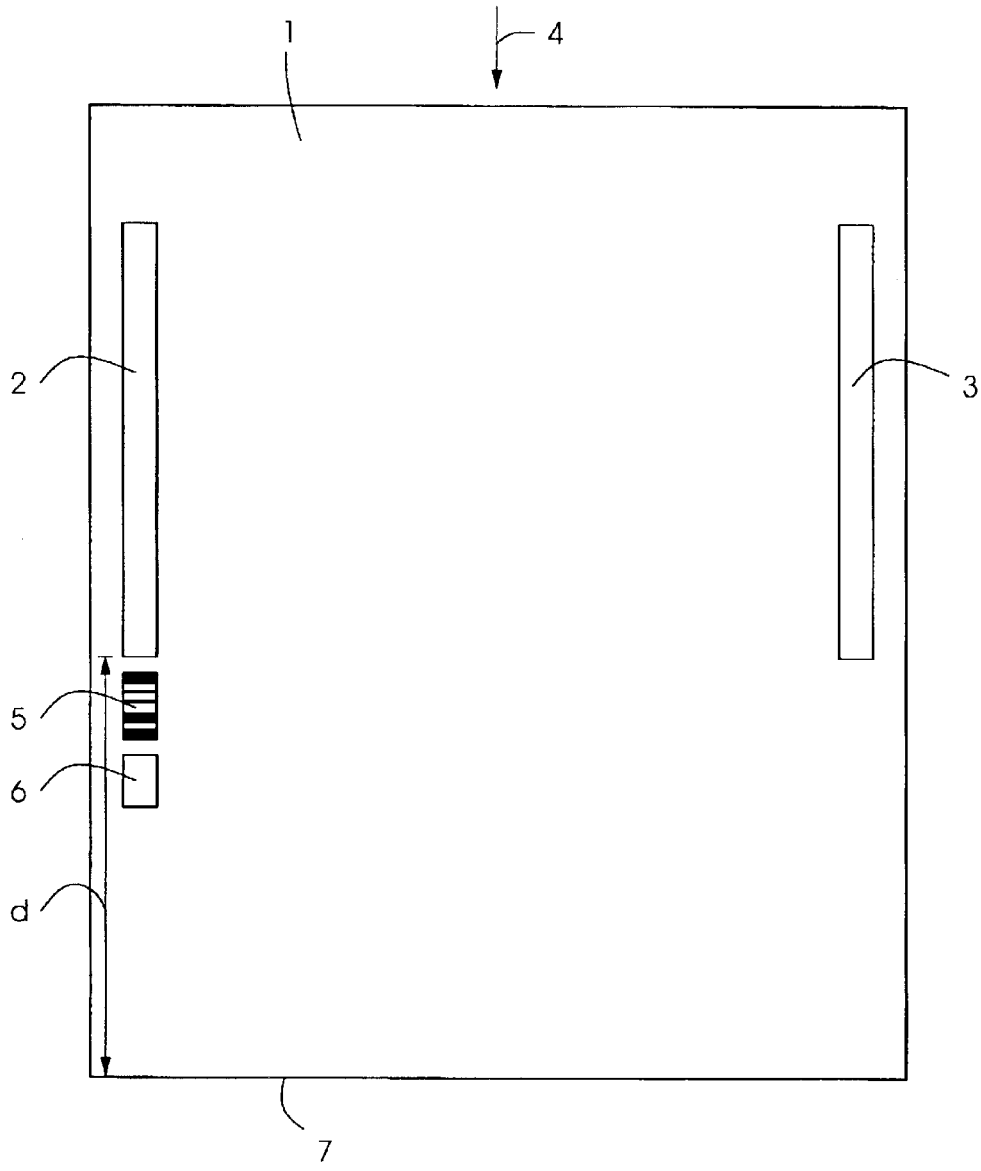
FIG. 2 shows a printed sheet, which, compared to the sheet shown in FIG. 1, has an additional, second register mark on the opposite side.

Sheet 1 shown in FIG. 2 differs from sheet 1 shown in FIG. 1 only in that it also has an additional register mark 3 on the left side, viewed in sheet travel direction 4. Data in informational block 5 point to the existence of another register mark 3, so that an additional read sensor 15 (FIG. 3) provided in a printing substrate processing machine 8 is activated for the left side, or, rather, the read unit for the right register mark 2 is swiveled to the left side. Any mention in the following to only one informational block 5 in no way signifies a limitation to just one block, since a plurality of informational blocks 5 may also be applied in the side regions of a substrate 1 and of a print form 11, when such a need arises.

Figure 3:
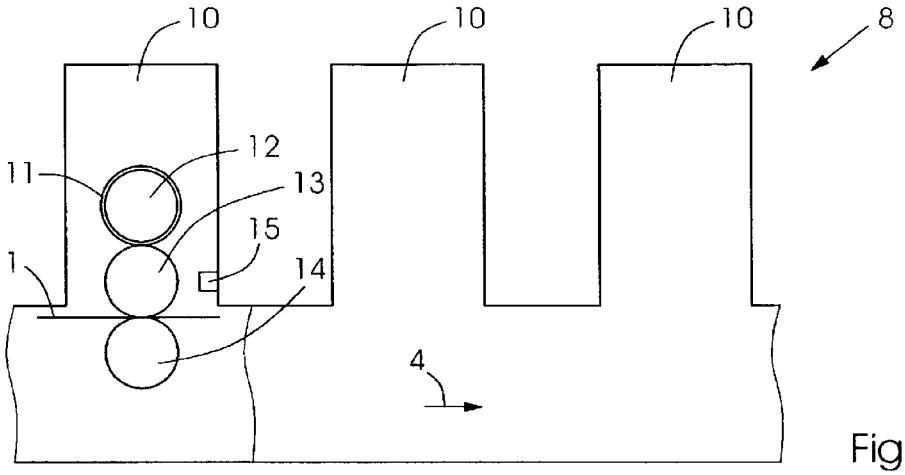
FIG. 3 shows a printing press having four print units, including a device according to the present invention for reading in data from an informational block applied to a substrate in encoded form.

In FIG. 3, one can discern a printing substrate processing machine 8 which is able to read out encoded data from an informational block 5 on a substrate, in this case a paper sheet 1, thereby enabling these data to be processed in a control of printing substrate processing machine 8. Printing substrate processing machine 8 is a printing press having four print units 10, the first of print units 10 in sheet travel direction 4 being depicted in detail. Feeder and delivery units have been omitted in the illustration. The design of the remaining three print units 10 may be the same as or different from that of the first print unit 10. In this context, only the first of print units 10 advantageously has a read sensor 15 for reading out the encoded data from an informational block 5 in the edge region of a printed sheet 1. The first of print units 10 includes an inking system (not shown here), a printing cylinder 12 having a print form 11 clamped therein, a transfer cylinder 13, usually a blanket cylinder, and an impression cylinder 14. The substrate, here a paper sheet 1, is moved through, between blanket cylinder 13 and impression cylinder 14, and is printed on in the process. Thus, printing cylinder 12 supplied with ink from the inking system (not shown here) applies the contents of print form 11 via blanket cylinder 13 to sheet 1. In this way, the data from an informational block 5 present on print form 11 in the edge regions are also printed on sheet 1 and may thus be read out by read sensor 15 disposed in sheet travel direction 4 following the first of print units 10.

The first of print units 10 is advantageously provided for printing black, since black is not susceptible to color deviations. Before sheet 1 reaches next print unit 10, any existing data stored in informational block 5 pertaining to color profile and color zones are available in a timely fashion for the automatic control of printing substrate processing machine 8. The same applies to data for controlling register accuracy, which likewise first play a role starting with the second of print units 10. In addition, for further processing of printed sheet 1, printing press 8 may supply a folding machine (not shown here) with data from informational block 5, in that printing press 8 is linked via a data line or the like with the folding machine. In this way, data may also be transmitted from a pre-press stage 9 to a folding machine for further processing. When the folding machine is not able to communicate with the printing press via a data line, it is still possible to provide the folding machine with a separate read sensor 15, which then reads out the data from informational block 5 in the folding machine once more, independently of printing press 8, and transmits the same to a machine control of the folding machine. In this way, separately existing folding machines may be automatically supplied with data from informational block 5, as well.

Figure 4:
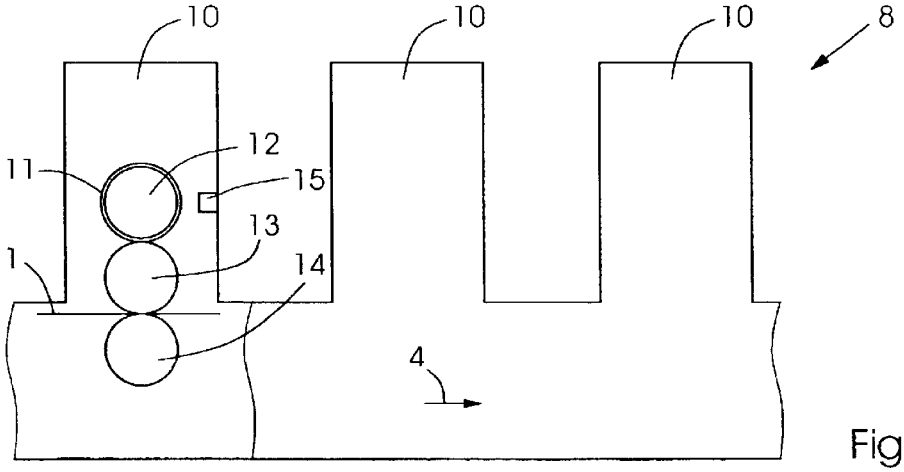
FIG. 4 shows a printing press having four print units and a device according to the present invention for directly reading out data from an informational block applied to a print form in encoded form.

A modified form of the design in accordance with FIG. 3 is illustrated in FIG. 4. It shows a printing substrate processing machine 8 likewise having four print units 10, which are basically identical in construction to print units 10 of the printing press shown in FIG. 3. The difference lies in the configuration of read sensor 15, which, in this case, does not read out informational block 5 after it is printed out on sheet 1, but rather directly reads out the edge regions of print form 11 on printing cylinder 12, thereby making the information available already before the first printing of sheet 1. This is important, for example, when knowledge of the distance of a register mark 2, 3 from front sheet edge 7 is already needed at first print unit 1. In such a case, the data must be read out by sensor 15 before the first printing takes place in first print unit 10, to render possible a timely automatic control.

Figure 5:
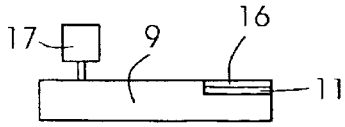
FIG. 5 shows a schematic representation of a pre-press stage in accordance with the present invention.

FIG. 5 additionally depicts, by way of example, a pre-press stage 9 including a monitor 17 for operator guidance and a plate exposure unit 16 for producing a print form 11. In this context, in pre-press stage 9, the preferably digital data are generated for informational block 5, converted into a bar-code, and applied using plate exposure unit 16, together with text and graphics, to print form 11. Finished print form 11 is then ready for application in a printing substrate processing machine 8 and is, thus, able to transmit the data of informational block 5 from pre-press stage 9 to printing substrate processing machine 8. Thus, the data to be transmitted are always supplied at the same time as print form 11, without the need for a separate data transmission.

From the design of a device according to FIGS. 3 and 4, in accordance with the present invention, one derives the advantage that a printing substrate processing machine 8 is enabled to read out the data of an informational block 5, from a print form 11, simply and cost-effectively and even by retrofitting. A read sensor 15 then merely needs to be installed and connected to the machine control of printing substrate processing machine 8.

REFERENCE NUEMRAL LIST

1 substrate/sheet
2 register mark
3 second register mark
4 sheet travel direction
5 informational block including encoded information
6 optional mark starting sequence
7 front sheet edge
8 printing substrate processing machine/printing press
9 pre-press stage
10 print unit
11 print form
12 printing cylinder
13 transfer cylinder/blanket cylinder
14 impression cylinder
15 read sensor
16 plate exposure unit
17 monitor
d distance sheet front edge to register mark

What is claimed is:

1. A method for automatically transmitting data from a first printing substrate processing machine having at least one print unit and one print form for printing on a printing substrate, to a further printing substrate processing machine, the method comprising the steps of:

applying in the first printing substrate processing machine the data to be transmitted to the further printing substrate processing machine, in a machine-readable form, to the print form, and reading out the data by the further printing substrate processing machine.

2. The method as recited in claim 1 wherein the further printing substrate processing machine is a folding machine.

3. The method as recited in claim 1 wherein the data to be transmitted to the printing substrate processing machine are further applied by way of the print form to the substrate.

4. The method as recited in claim 1 wherein the data to be transmitted to the printing substrate processing machine is are applied in the lateral edge regions of the substrate.

5. The method as recited in claim 1 wherein the data describe a setpoint position of a register mark in relation to a sheet edge of a substrate.

6. The method as recited in claim 1 wherein the data are applied to the print form in the form of a bar-code.

7. The method as recited in claim 1 wherein the data to be transmitted contain a number of printing operations to be executed.

8. The method as recited in claim 1 wherein the data to be transmitted contain a sequence of colors in the print units of the printing substrate processing machine, and a comparison is made to the color sequence stored in the printing substrate processing machine.

9. The method as recited in claim 1 wherein the data to be transmitted contain information for optional equipment.

10. The method as recited in claim 9 wherein the optional equipment is at least one of a tape inserter and a numbering box.

11. The method as recited in claim 1 wherein the data to be transmitted include a color profile pertaining to a particular print job.

12. A method for automatically transmitting data from a pre-press stage to a printing substrate processing machine having at least one print unit and one print form for printing on a printing substrate, the method comprising the steps of:

applying in the pre-press stage the data to be transmitted to the printing substrate processing machine, in a machine-readable form, to the print form, and reading out the data at the printing substrate processing machine;

wherein the data describe a setpoint position of a register mark in relation to a sheet edge of a substrate.

13. A device for transmitting data comprising:

a first printing substrate processing machine having at least one print unit and one print form for printing on a printing substrate, a further printing substrate processing machine, a device in the first printing substrate processing machine for applying data to be transmitted to the further printing substrate processing machine in a machine-readable form to the print form, and a device in the further printing substrate processing machine for reading out the data to be transmitted.

14. The device as recited in claim 13 wherein the further printing substrate processing machine is a folding machine.

15. The device as recited in claim 13 wherein the print form applies the data to be transmitted in the printing substrate processing machine to the substrate.

16. The device as recited in claim 13 wherein the device for reading out is a read sensor capable of reading the data applied to the print form or the data applied by the print form to a substrate, the read sensor transmitting the data to a control of the further printing substrate processing machine.

17. The device as recited in claim 13 wherein the data to be transmitted are located in the lateral edge regions of the print form and of the substrate.

18. The device as recited in claim 13 wherein the data on the print form and on the substrate have the form of a bar-code, and the device for reading out is a bar-code reader.

19. The device as recited in claim 13 wherein the first printing substrate processing machine is a printing press.

20. The device as recited in claim 13 wherein the printing substrate processing machine is a printing press having a folding machine linked thereto.

21. The device as recited in claim 13 wherein the further printing substrate processing machine is a folding machine.

* * * * *